US005813833A

United States Patent [19]

Addie et al.

[11] Patent Number: 5,813,833

[45] Date of Patent: Sep. 29, 1998

[54] HIGH CAPACITY, LARGE SPHERE PASSING, SLURRY PUMP

[75] Inventors: Graeme R. Addie; Robert J. Visintainer, both of Augusta, Ga.

[73] Assignee: GIW Industries, Inc., Grovetown, Ga.

[21] Appl. No.: 703,948

[22] Filed: Aug. 29, 1996

Related U.S. Application Data

[60] Provisional application No. 60/003,007 Aug. 31, 1995.

[51] Int. Cl.[6] ..... F04D 29/44

[52] U.S. Cl. ..... 415/206; 415/121.1; 416/223 B

[58] Field of Search ..... 415/206, 121.1, 415/228; 416/223 B

[56] References Cited

U.S. PATENT DOCUMENTS

| | | | |
|---|---|---|---|
| 398,301 | 2/1889 | Willson | 415/228 |
| 1,633,609 | 6/1927 | Schmidt | 415/228 |
| 3,130,678 | 4/1964 | Chenault | 415/206 |
| 3,130,679 | 4/1964 | Sence . | |
| 3,148,464 | 9/1964 | Jones | 415/206 |
| 3,295,455 | 1/1967 | Patay et al. | 415/228 |
| 3,447,475 | 6/1969 | Blum | 415/121.1 |
| 3,734,640 | 5/1973 | Daniel | 415/228 |

FOREIGN PATENT DOCUMENTS

| | | |
|---|---|---|
| 629615 | 11/1927 | France . |
| 1196506 | 7/1965 | Germany . |
| 2442446 | 3/1976 | Germany . |
| 2160932 | 1/1986 | United Kingdom . |

*Primary Examiner*—John T. Kwon
*Attorney, Agent, or Firm*—Isaf, Vaughan & Kerr

[57] ABSTRACT

A centrifugal slurry pump is disclosed which includes a specifically designed impeller having three circumferentially spaced vanes mounted between a back disc shaped shroud and a front open annular shroud. The vanes are thick in cross-section for wear-resistance and channels formed between adjacent ones of the vanes permit a relatively large sphere, or sphere-like objects, to pass therethrough, the sphere having a diameter of in excess of 14 inches, while maintaining an efficiency in excess of 80% and a head in excess of 30 feet. The vanes have a mixed pitch and a negative overlap, with quite large channels formed between adjacent vanes so as to pass the large spheres which are encountered during dredging operations.

22 Claims, 5 Drawing Sheets

2/5

HIGH CAPACITY, LARGE SPHERE PASSING, SLURRY PUMP

FIELD OF INVENTION

This invention relates to a centrifugal pump and is more particularly concerned with a high capacity, large sphere-passing slurry pump.

RELATED APPLICATIONS

This application is based on provisional application Ser. No. 60/003,007, filed on Aug. 31, 1995.

BACKGROUND OF THE INVENTION

In the past, centrifugal pumps have been used extensively for pumping slurries. Dredging operations often utilize two or more tandemly arranged centrifugal pumps to pump slurries. The slurries may consist of any fluid and particles. The particles may be as small as a few microns to as large as 500 mm (20 inches) or more, and the density of the slurry mixture may be higher than 1.8 times the density of water.

Conventional centrifugal water pumps may pump slurries having a low particulate concentration, but once such particles become large or if the particle concentration becomes large, the erosion and wear of the various parts become so severe that special designs and constructions for the pump are necessary to provide an acceptable pump service life. Where wear is a severe problem, the centrifugal pumps are usually made of white iron and have quite thick impeller vanes which will withstand the abrasion.

When dredging operations require a centrifugal pump to be used as a dredge pump for removing materials such as sand, gravel and other objects from an ocean floor, it is not unusual for such a pump to be required to remove spheres or sphere-like objects, as large as 500 millimeters (20 inches) from time to time. Modifications to the centrifugal pump's hydraulic passage, inlet cross-sectional area, and sphere clearance which are necessary to provide acceptable performance in passing those large objects, generally have an adverse affect on the hydraulic and mechanical efficiency of such centrifugal pumps. When such slurry pumps are used for dredging purposes and arranged in tandem, one of the pumps is usually mounted onboard a dredging vessel and the second pump is mounted at a distal end of a boom or "ladder." The second pump is submerged by the boom to position the second pump at the bottom of a river or larger body of water. Such pumps are referred to as "ladder pumps." Ladder pumps urge the water and aggregate, such as sand, gravel, rocks and relatively large spheres or sphere-like objects into the suction nozzle of the onboard centrifugal pump, by generating a vacuum at the intake of the ladder pump and then discharging this slurry through the ladder pump discharge nozzle and into a pipe leading upwardly to the onboard pump. The prime mover for the ladder pump may be located adjacent the pump or onboard the vessel where appropriate shafts and gears transmit the power to the submerged ladder pump. The onboard dredge pump is usually mounted near the prime mover or where it can be readily and easily accessed by an operator, who may also steer the dredging vessel.

When the digging depth of the ladder pump is great, the net positive suction head (NPSH) requirements for the ladder pump are limited by the depth at which the pump must operate and also by the concentration of the slurry which is to be conveyed. NPSH is defined as the gauge reading in feet or meters taken on an inlet of the pump (the pump centerline) minus the gauge vapor pressure in feet or meters corresponding to the temperature of the liquid, plus velocity head at the pump inlet. Thus, these centrifugal pumps, in the interest of balance, control, and cost, must ideally be of a size, weight and power which is limited. Modern ladder pumps, therefore, are usually designed for the same capacity as an onboard pump but with a minimum head that can provide sufficient lift of the dredged slurry to the onboard pump so that the operation is free of cavitation.

The impeller of a typical, rather small diameter modern ladder pump has an effective diameter usually only 125% of the suction diameter of the intake of the pump, which limits the size of sphere-like objects which will pass through the typical pump. The sphere-like objects are required to pass between the leading edge of the leading face or surface of one vane and the trailing face of the next adjacent vane. Such pumps are also required to be made of abrasive resistant material, such as white iron. The vanes, themselves, are quite thick to withstand very substantial abrasion during operation.

The requirements of a pump which includes small inlet diameter that is capable of passing large spheres and which also must include a thick vane section impeller, a medium specific working speed, and a wear-resistant semi-volute shell collector, imposes severe restrictions on the hydraulic designer as to be achieved in terms of efficiency and suction performance.

BRIEF DESCRIPTION OF THE INVENTION

The present invention seeks to overcome the problems of the prior art by providing a centrifugal pump which, while being capable of passing relatively large spheres or sphere-like objects, is compact, rugged, efficient and particularly suited for pumping these large spheres, and for use as a ladder pump.

Briefly described, the present invention includes a low head (low power) centrifugal ladder pump which has a wear-resistant, semi-volute shell which houses an impeller. The impeller includes a restricted number of vanes of negative (no) overlap, which are capable of passing relatively large spheres or sphere-like objects through the impeller channels and which still are capable of achieving a respectable efficiency and a substantial net positive suction head (NPSH) performance. The impeller of the present invention may include three circumferentially, equally spaced, mixed flow vanes, the rear ends of which originate from a rear shroud and the forward ends of which terminate on a rear surface of an open annular shroud. The shroud of the impeller has a larger outside diameter than an outside diameter of the back shroud. Each vane tapers toward the shroud. Thus, the vanes diverge forwardly from each other to a center portion of the back shroud. The inner or trailing faces of the vanes are concave, the outer surfaces or leading faces of the vanes are convex, and the trailing surfaces are concave. Each vane has a specification as to curvature of these opposed surfaces along their respective lengths. The impeller of the present invention is of special design and operates with a particular type of collector. The impeller vanes are of mixed flow design with a near radial outlet.

Accordingly, it is an object of the present invention to provide a centrifugal-type slurry pump which is designed to pass large spheres or sphere-like objects in a slurry through the pump without an appreciable loss of efficiency.

Another object of the present invention is to provide a centrifugal-type slurry pump which is particularly suited for use as a ladder pump or dredge pump.

Still another object of the present invention is to provide a centrifugal-type slurry pump which is particularly suitable for use as a ladder pump used in tandem with an onboard or inboard pump for dredging operations.

Yet another object of the present invention is to provide a centrifugal pump which is relatively inexpensive to manufacture, durable in structure and efficient in operation.

Finally, another object of the present invention is to provide a centrifugal-type slurry pump which is capable of passing relatively large spheres or sphere-like objects therethrough while also being compact, rugged and efficient.

Other objects, features and advantages of the present invention will become apparent from the following description when considered in conjunction with the accompanying drawings, wherein like characters of reference designate corresponding parts throughout the several views.

DETAILED DESCRIPTION

Referring now in detail to the embodiment chosen for the purpose of illustrating the preferred embodiment of the present invention, numeral 10 denotes generally the semi-volute shell or shell collector of a centrifugal pump of the present invention. Shell 10 includes a discharge nozzle 12 which protrudes outwardly therefrom in a tangential direction. Discharge nozzle 12 terminates at discharge opening 13.

Figure 1:
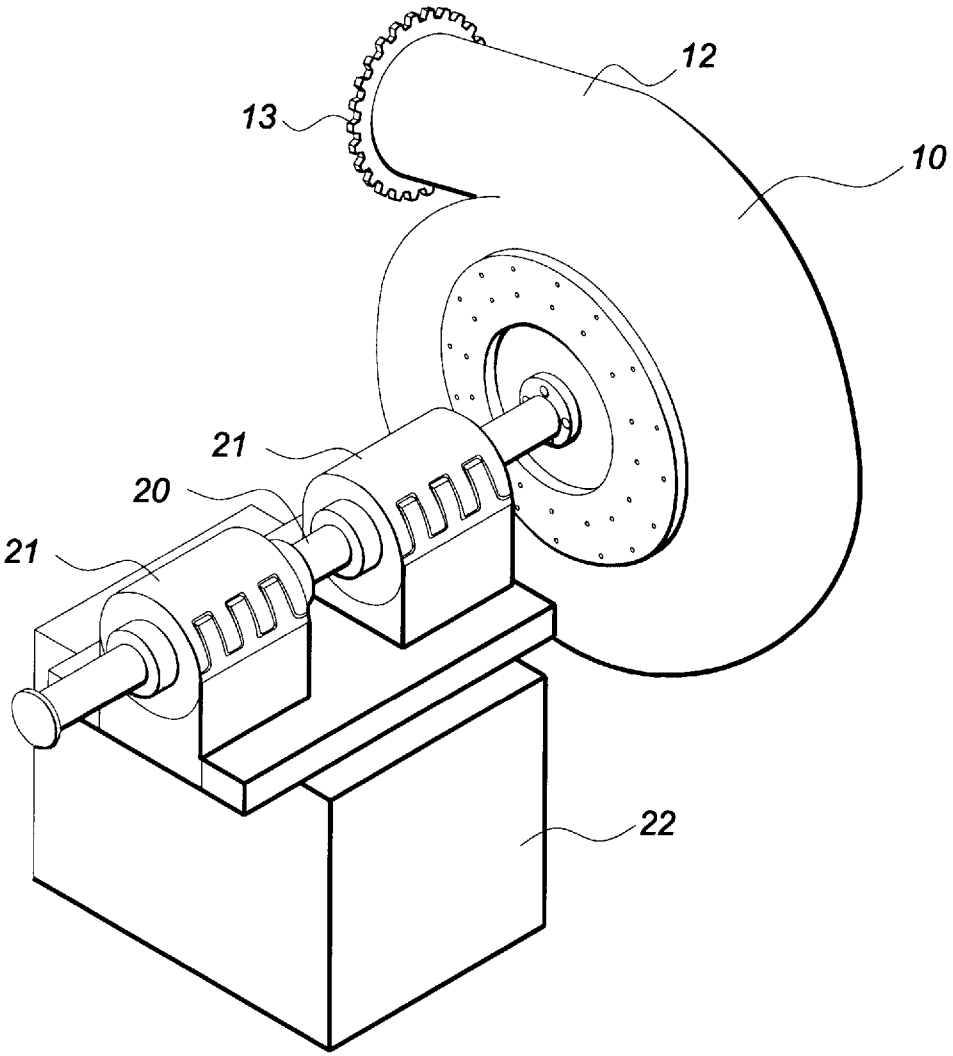
FIG. 1 is a perspective view of a slurry pump constructed in accordance with the present invention.
Figures 2, 3:
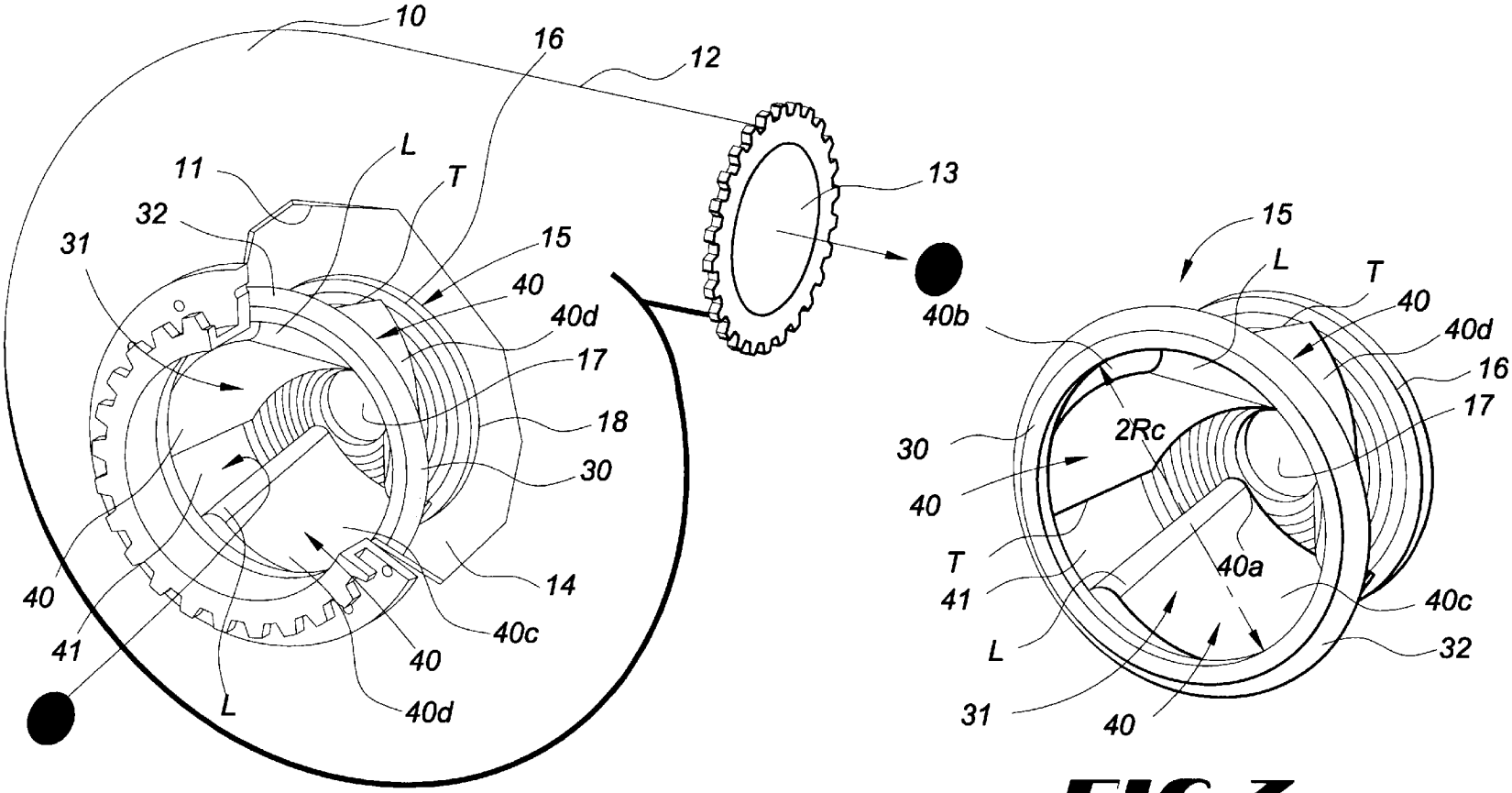
FIG. 2 is a fragmentary perspective view of the reverse side of the slurry pump illustrated in FIG. 1.
FIG. 3 is a perspective view of the impeller of the slurry pump illustrated in FIG. 1.

As best seen in FIGS. 2 and 3, the shell 10 has a hollow central interior 14 which receives the impeller, denoted generally by the numeral 15. Impeller 15 includes a disc-shaped back shroud 16 with a bulbous forwardly protruding central hub 17 of smaller diameter than the diameter of the back shroud 16. The central portion of the rear side of the back shroud 16 is internally threaded and receives the threaded end of a drive shaft 20, seen in FIG. 1. This drive shaft 20 protrudes away from the back shroud 16 and is rotatably supported by suitable bearings within a pair of spaced, aligned pillar blocks 21 mounted on a common support block 22. A motor (not shown) rotates the shaft 20 and the impeller 15 within shell 10. The usual packing (not shown) for surrounding shaft 20 in the central portion of the back side of the shell 10, prevents leakage as the pump pumps the slurry.

Figure 6:
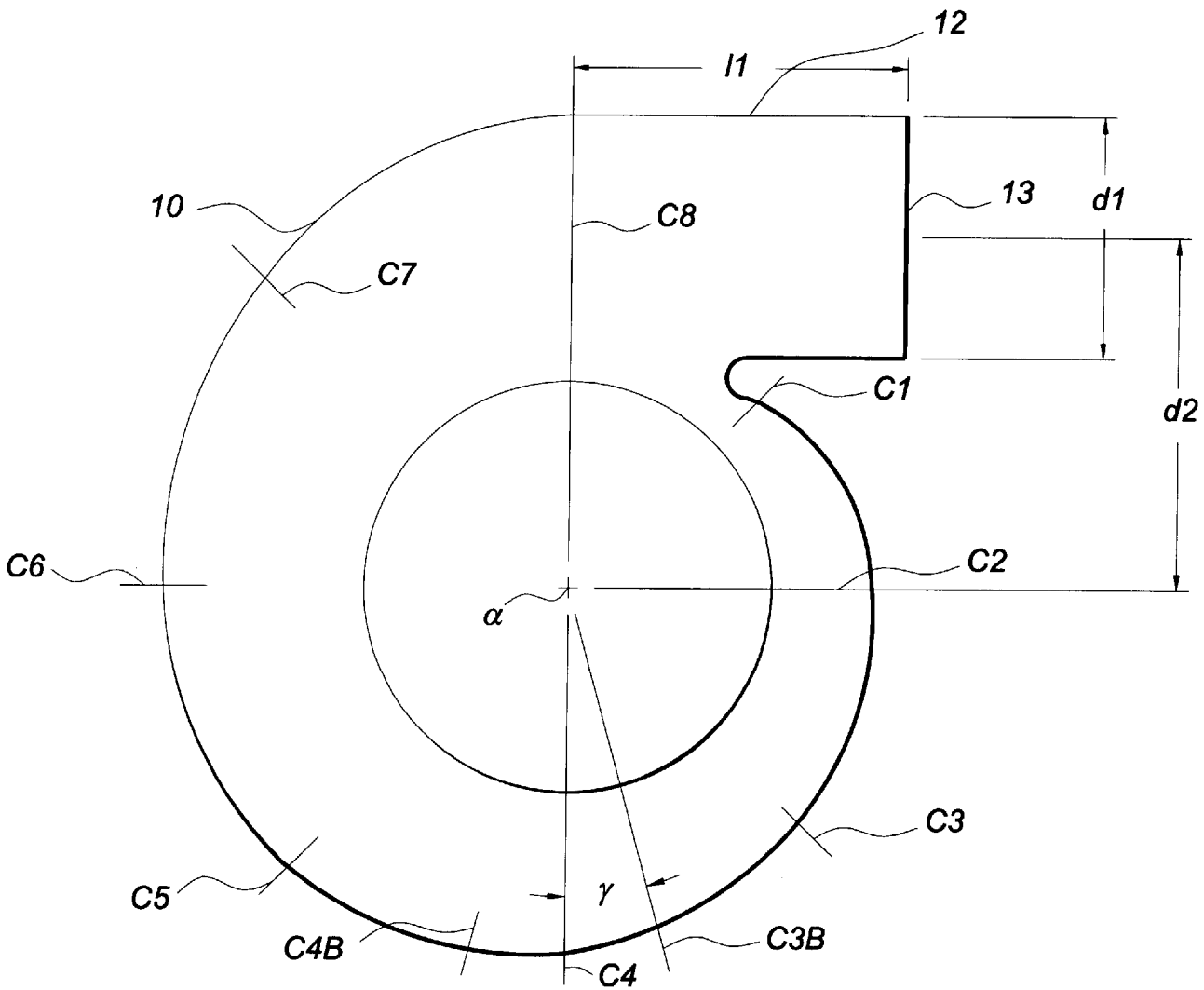
FIG. 6 is a schematic side elevational view of the shell collector of the pump illustrated in FIG. 1.

Forwardly of the back shroud 16 is an open annular shroud 30 which has a larger outside diameter than the diameter of the back shroud 16. This shroud 30 includes a circular central opening or intake 31. The shroud 30 is concentric with the back shroud 16 about the main axis $\alpha$ of the pump 10 and shaft 20 as is illustrated in FIG. 6. The periphery of the shroud 30 is machined to form a circular front surface 32 which is concentric with the remainder of the impeller 15. The rear shroud 16 includes a similar rear bearing surface 18 which rides against the appropriate wearing ring (not shown) within the interior of the shell 10. Extending between the shroud 30 and the rear shroud 16 are three circumferential, equally spaced mixed pitch vanes 40, the proximal ends 40*a* of which are respectively integrally secured to the front surface of the back shroud 16. The distal ends 40*b* of these vanes 40 are secured to the back surface of the annular shroud 30. Preferably, the impeller 15 is cast as an integral unit out of white iron or some other wear-resistant material.

The vanes 40 protrude essentially forwardly from a back shroud 16, the proximal ends 40*a* of each vane preferably occupying an arc or sweep of about 105° along the front surface of back shroud 16 and the distal end 40*b* of each vane occupying an arc or sweep of 80° along the back surface of the annular shroud 30. In the preferred embodiment, the maximum impeller passage of channels 41 between the vanes 40, is about 14.25 inches or approximately 37% of the suction inlet diameter (2 Re) (FIG. 3) of central opening 31. Each vane 40 is identical to the other, the vanes 40 being spaced evenly throughout the circumference of the impeller 15. Each vane 40 has a thickness at the inlet end of the impeller of about 4% of the suction diameter (2 Re). Each vane 40, has a body which occupies about 7% of the suction diameter (2 Re) and each vane 40, at its tip, or proximal end 40*a* occupies about 4% of the suction diameter (2 Re).

The shell or casing 10 has a radial geometry in the plane of the impeller 15 as shown in FIG. 6. The width of the collector shell 10, in cross-section, may vary somewhat, but is normally about 60% of the suction diameter (2 Re).

The vanes 40, the front 30 and the back shroud 16 define the three circumferential spaced impeller channels 41 through which slurry is drawn into the impeller central opening 31. Impeller 15 urges the slurry by centrifugal force and the orbital movement of the impeller vanes 40 outwardly into the single arcuate semi-rotate collector 10. The inner peripheral surface of collector 10 is defined by a progressively increasing cross-section and leads to the discharge nozzle 12, and to the opening 13.

Figure 4:
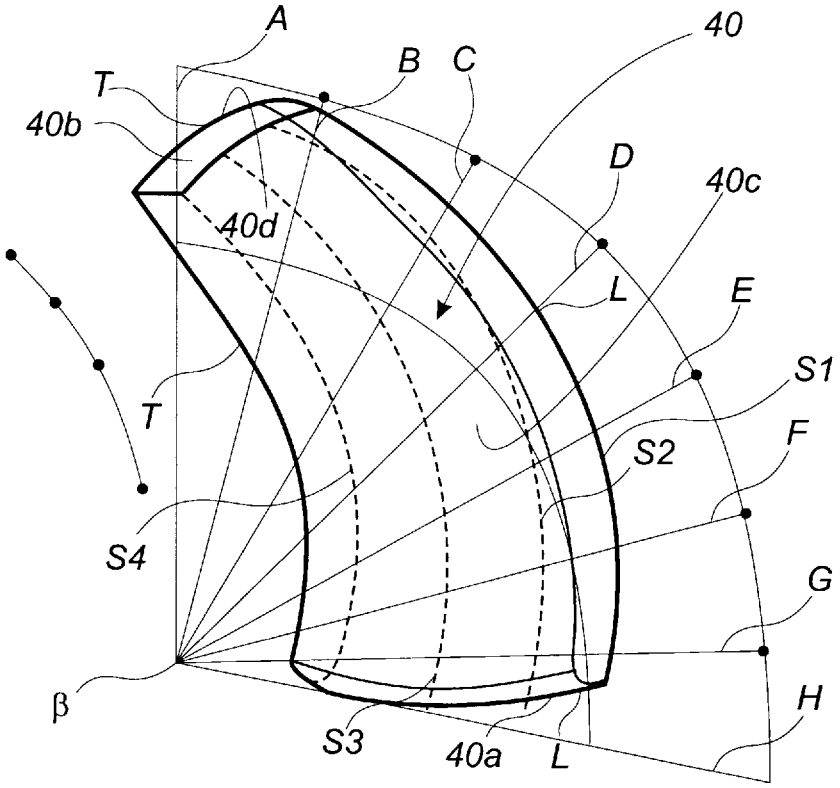
FIG. 4 is a schematic meridional diagram imposed on one of the vanes of the impeller shown in FIG. 3 for providing median coordinates for construction of the vanes.
Figure 5:
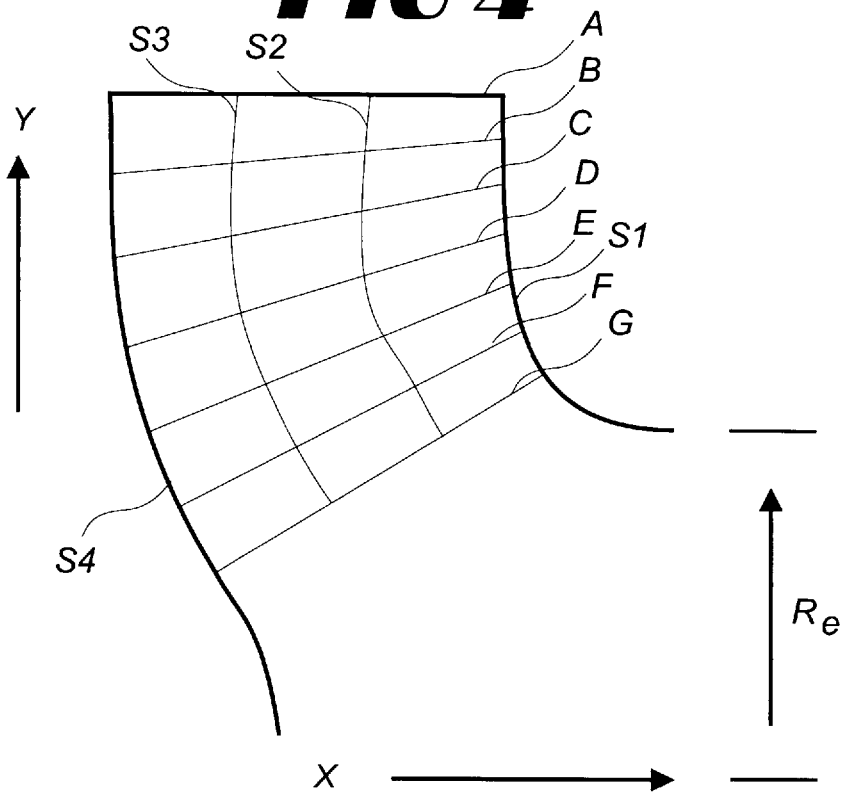
FIG. 5 is another radial section diagram showing the sweep of each vane at the back of the shroud of the impeller of FIG. 3.

The impeller 15 is of a special, thick, vane-type, mixed flow design, in which the channels 41 have a near radial outlet defined by the negative overlap (none) of the vanes 40, thereby providing a large sphere-like object passing capacity between the leading edge L of one vane 40 and an intermediate portion of the concaved inner surface of shell collector 10, as specified in the relative geometry depicted in FIGS. 4 and 5. In FIG. 4, the vane 40 includes a proximal end 40*a*, a distal end 40*b*, an inner face or surface 40*c* and an outer or leading face or surface 40*d*. Meridian lines A, B, C, D, E, F, G and H are spaced about 15° apart across the vane 40 at radial locations. The solid line labeled "L", shown in FIG. 3, is the leading edge of vane 40 and the solid line is labeled "T" is the trailing edge. Tables I and II provide the parameters for the vane 40. Table I recites angles with respect to axis $\beta$ in FIG. 4. The stream lines S1, S2, S3 and S4, indicated by broken lines in FIG. 4, are all leading face 40*d* stream lines along leading face 40*d* of vane 40.

TABLE I

| L-Edge and T-Edge Angular Locations | | | | |
|---|---|---|---|---|
| Sections | Stream #1 | Stream #2 | Stream #3 | Stream #4 |
| T-Edge | 15.0 Deg. | 10.0 Deg. | 5.2 Deg. | 0.0 Deg. |
| L-Edge | 95.0 Deg. | 97.6 Deg. | 101.0 Deg. | 105.0 Deg. |

By reference to Table I, the angular locations of edge "L" and edge "T" can be ascertained with respect to the streams indicated as leading face streamline S1, S2, S3 and S4.

By reference to the following Table II, the "X" and "Y" coordinates of the sections along the radial stream lines S1, S2, S3 and S4 and meridian lines A, B, C, D, E, F, G and H, the leading edge L and trailing edge T can be ascertained.

TABLE II

| | Leading Face Coordinates of Vane Radial Section as a Percent of Re | | | | | | | |
|---|---|---|---|---|---|---|---|---|
| Radial | Streamline 4 | | Streamline 3 | | Streamline 2 | | Streamline 1 | |
| Sections | X | Y | X | Y | X | Y | X | Y |
| T-Edge | 1.6 | 115.8 | 45.6 | 123.4 | 86.1 | 130.4 | 123.5 | 136.8 |
| A | 1.6 | 115.8 | | | | | | |
| B | 5.2 | 99.4 | 49.5 | 114.4 | 88.4 | 126.6 | 123.5 | 136.8 |
| C | 11.1 | 82.8 | 57.8 | 100.7 | 95.9 | 116.8 | 128.7 | 128.7 |
| D | 18.5 | 68.0 | 68.6 | 89.0 | 104.0 | 108.5 | 132.7 | 126.7 |
| E | 26.5 | 55.7 | 80.4 | 79.8 | 113.2 | 102.0 | 136.6 | 119.7 |
| F | 34.3 | 46.0 | 92.7 | 73.4 | 122.9 | 96.5 | 141.8 | 115.1 |
| G | 41.1 | 38.5 | 104.2 | 69.1 | 133.5 | 92.3 | 150.1 | 109.5 |
| L-Edge | 47.5 | 32.9 | 111.8 | 67.1 | 139.1 | 90.3 | 153.8 | 107.6 |

In a preferred embodiment, the arc or sweep of each vane 40 at its proximal end 40*a* along back shroud 16 is 105° from the trailing edge T to leading edge L and the arc or sweep of each vane 40 at its distal end 40*b* along shroud 30 is 80°, including a lag on the trig edge of 15°. In this embodiment, the maximum passage of channel 41 between the vanes 40 is close to 14.25 inches or 37% of the suction inlet diameter (2 Re). The geometry of the impeller meridional section front and back of the impeller 15 is defined also in Table II above. This defines the nominal diameter of the impeller (which can vary slightly) as 126% at shroud 30 and 116% at the back of shroud 16 of the suction diameter (2 Re). The vanes 40 each have a thickness at their distal ends 40*b* adjacent the central opening 31 of about 4%; along the body of vane 40 about 7%; and at the tips or proximal ends 40*a* of about 4%, respectively, of the suction diameter.

The shell 10 has radial geometry in the plane of axis α (the impeller diameter) illustrated in FIGS. 5 and 6. The width of the shell collector 10 in the cross-section, may vary from about 55% to about 65%, but is normally 60% of the suction diameter.

FIG. 6 illustrates sections of shell collector 10 which are disposed every 45° around axis α, except for sections C3-C3B and C4-C4B. The symbol 2 designates a 15° increment, and the circumferential distance between C4B and C5 is 22.5°. Table III below lists the coordinates of points C1 through C8 as illustrated in FIG. 6.

TABLE III

| Coordinates Points C1–C8 As a Percentage of Re | | |
|---|---|---|
| Points | X | Y |
| C1 | 154.0 | 154.0 |
| C2 | 253.7 | 0.0 |
| C3 | 205.6 | −205.6 |
| C3B | 80.8 | −301.2 |
| C4 | 0.0 | −321.9 |
| C4B | −84.9 | −316.6 |
| C5 | −239.1 | −239.1 |
| C6 | −352.1 | 0.0 |
| C7 | −259.1 | −259.1 |
| C8 | 0.0 | 387.6 |

In FIG. 6, where Re the suction inlet radius (FIG. 5) equals 19 inches, the length $l_1$, from C8 to the discharge nozzle opening 13 of the nozzle 12, is 53.5 inches (1358.9 mm or 2.816 Re), the distance $d_2$ from the axis of nozzle 12 to axis α is 55.375 inches (1406.2 mm or 2.914 Re) and the inside diameter of $d_1$ of the nozzle 13 is 38 inches (965.2 mm or 2.0 Re).

Figure 7:
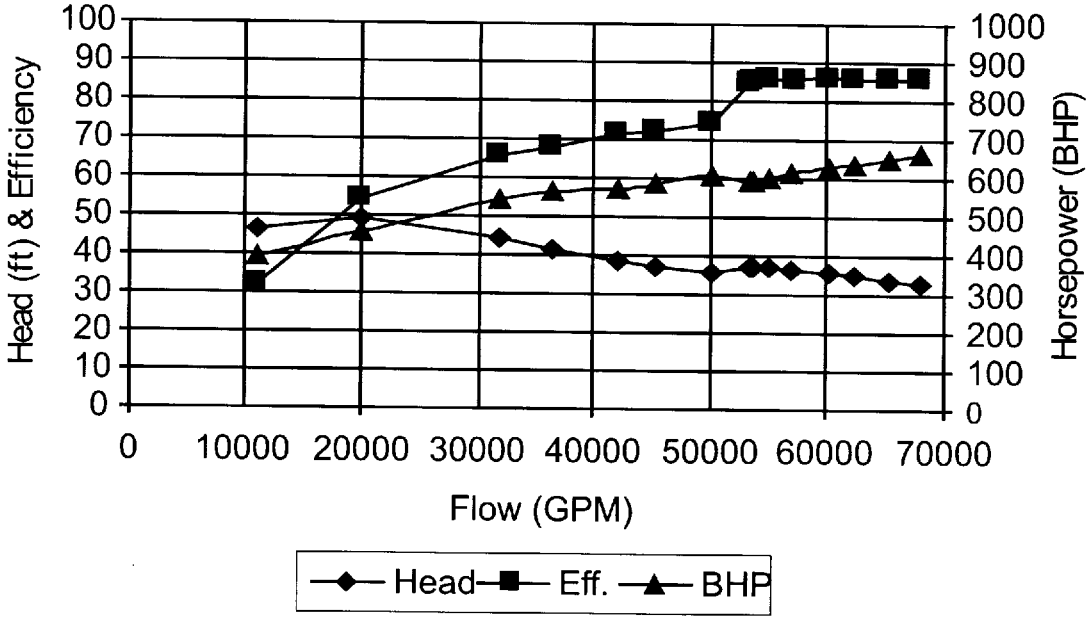
FIG. 7 is a diagram showing the head, efficiency and horsepower of the pump depicted in FIG. 1.
Figure 8:
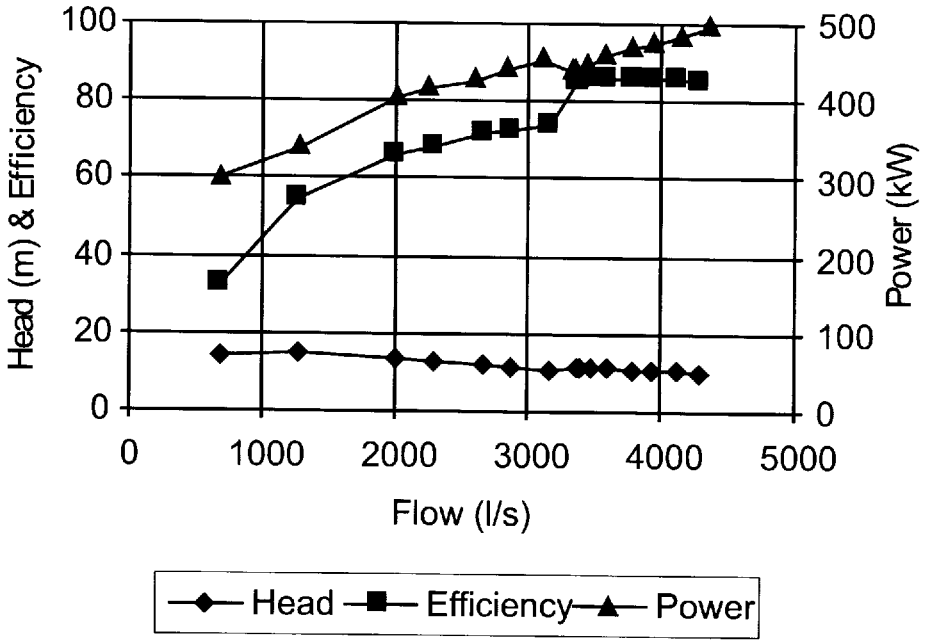
FIG. 8 is a diagram showing the flow characteristics of the slurry pump shown in FIG. 1.

In the preferred embodiment, where the suction radius Re is 19 inches or 482.6 mm, the pump is capable of passing a sphere as large as 14.25 inches or 362 mm, has long wearing life vanes 40 of 2.75 inches thickness or 70 mm, lying within the semi-volute collector 10 that will give good wear over a wide range of ladder pump operating conditions and achieve a head quantity, efficiency and suction performance as shown in the tables of FIG. 7 and FIG. 8.

To determine performance of the inventive pump, the following calculations for head and efficiency are made. The volume of liquid pumped is referred to as capacity and is generally measured in gallons per minute (gpm) or liters per second. The height to which liquid can be raised by a centrifugal pump is called total dynamic head and is measure in feet or meters. This does not depend on the nature of the liquid (its specific gravity) so long as the liquid viscosity is not higher than that of water. Water performance of centrifugal pumps is used as a standard of comparison because practically all commercial testing of pumps is done with water. For a horizontal pump the total dynamic head is defined as:

$$H = H_d - H_s + \frac{v_d^2}{2g} - \frac{v_s^2}{2g}$$

$H_d$ is the discharge head as measured at the discharge nozzle and referred to the pump shaft centerline, and is expressed in feet or meters, $H_s$ is the suction head expressed in feet or meters as measured at the suction nozzle and referred to the same datum. If the suction head is negative, the term $H_s$ in that equation above becomes positive. The last two terms of the equation above represent the difference in the kinetic energy or velocity heads at the discharge and suction nozzles.

The degree of hydraulic and mechanical performance of a pump is judged by its efficiency. This is defined as a ratio of pump energy output to the energy input applied to the pump shaft. The latter is the same as the driver's output and in US units is termed brake horsepower (BHP), as it generally determined by a standard brake test.

$$\text{Efficiency } e = \frac{\text{pump output}}{\text{bhp}} = \frac{Q\gamma H}{550 \times \text{bhp}}$$

where in the US system of units Q is capacity in cubic feet per second, γ is the specific weight of the liquid (for cold water=62.4 lb. per cu ft), and Qγ is the weight of liquid pumped per second. If the capacity is measured in gallons per minutes, the equation for water becomes:

$$e = \frac{gpm \times 8.33 \times H}{60 \times 550 \text{ bhp}} = \frac{gpm \times H}{3960 \text{ bhp}}$$

In the equation above, (gpm×H)/3960 is the pump output expressed in horsepower and is referred to as water horsepower (whp). If a liquid other than cold water is used, the water horsepower should be multiplied by the specific gravity of the liquid to obtain the pump output or liquid horsepower.

In the metric system where head is measured in meters and Qγ in liters per second is measured, efficiency e is expressed as follows:

$$e = \frac{Q_v \times H_t \times SG}{102 \times P};$$

where P is input power in kilowatts.

FIG. 7 graphically illustrates the characteristics of the pump described above. The diamonds show the head, in feet, the squares indicate the efficiency as a percent of 100% and the triangles indicate the horsepower consumption of the pump. Looking first at the head produced, the inventive pump achieves a maximum head of about 50 feet with a flow of 20,000 gallons per minute and then drops to a head of about 32 feet as the pump delivers about 68,000 gallons per minute. Regarding efficiency, FIG. 7 shows that at about 10,000 gallons per minute, the efficiency of the pump is above 30%, which is quite low; however, as the applied horsepower increases, the efficiency of the pump increases to about 85% at flows of about 52,000 gallons per minute.

FIG. 8 illustrates pump efficiency with respect to the power requirements in kilowatts, the flow in liters per second, the head generated in meters, and the efficiency as a percentage. Here, the head remains essentially constant, while the efficiency of the pump increases as the flow increases up to about 3,400 liters per second, where the efficiency levels off. Furthermore, the power requirements appear to gradually increase with an increase in flow. As illustrated in FIG. 7, the efficiency of the pump appears to level out at over 80% when delivering a large amount of slurry. Thus, the pump of the present invention has a very acceptable efficiency and yet will pass quite large spheres for the particular size pump. The pump 10 with a suction inlet diameter of 19 inches, vanes of 2.75 inches thickness and a semi-volute shell collector 10, provides the performance shown in the FIG. 8, and passes a sphere of 14.25 inches in size therethrough.

Pumps with different size suction inlets may have similar performance characteristics to the pump of the preferred embodiment if the dimensions of all wetted surfaces bear the same scaled proportions as the above described pump. A pump scaled in accordance with the present invention should have the same scaled performance, if scaled according to the generally acknowledged rules of scaling, laid out in the Hydraulic Institute Standard, except for the normal surface roughness effects, described in the Hydraulic Institute Standard. Centrifugal pumps constructed in accordance with the present invention should pass a solid of 37%±3% of the suction diameter (2 Re). Other model size pumps scaled exactly in every respect except that the diameter of the impeller is increased by up to 15%, should pass spheres equal to 37%±3% of the suction diameter (2 Re), if the resulting performance is scaled according to the Hydraulic Institute for both: (1) three dimensional true scale change, and (2) change of impeller diameter.

A second pump designed as a true scale of a first pump in the ratio S, where the first and second pumps have the same configuration, in the following configuration:

$$\frac{Q}{q} = \frac{S^3 N}{n};$$

$$\frac{H}{h} = \frac{S^2 (N)^2}{(n)^2}$$

where:

Q=the second pump flow rate (gallons per minute);

H=head produced by the second pump (in feet);

N=second pump speed (in RPM);

q=the first pump flow rate (in gallons per minute);

h=head produced by the first pump (in feet); and n=first pump speed (in RPM).

If carried out accurately, performance can be predicted within 2%.

For example, a pump scaled exactly in every respect with the present invention with the suction diameter (2 Re) of the impeller 15 being increased by up to 15% over the preferred embodiment and with a width of the shell collector 10 being increased by up to 25%, should then have a scaled performance, predictable in accordance with the Hydraulic Institute formulae set out above for both three dimensional true scale change and change of impeller diameter. More specifically, hydraulic Institute scales should predict the flow characteristics and parameter performance points for head and efficiency.

Similarly, a pump scaled exactly in every respect with the present invention except that the inside diameter of the impeller 15 is increased by up to 15%, and the inside widths of the shell collector 10 and the impeller 15 respectively, are increased by up to 25%, would also perform according to the Hydraulic Institute scales for both three-dimensional true scale change and change of impeller diameter.

It will be obvious to those skilled in the art that many variations may be made in the embodiment here chosen for the purpose of illustrating the present invention, without departing from the scope thereof, as defined by the appended claims.

We claim:

1. A centrifugal pump adapted to pump a slurry of water and solids therethrough, said pump comprising:

a shell in the form of a semi-volute collector formed about a central axis, said shell having:

a substantially circular front wall and a spaced substantially circular back wall;

a generally continuous outer side wall extending between said front wall and said rear wall;

a discharge nozzle disposed tangentially with respect to said side wall;

a discharge opening at a terminal end of said discharge nozzle;

a circular suction inlet defined in said front wall about said axis for allowing the slurry to enter said shell;

an impeller rotatably supported within said shell about said central axis, said impeller including:

a circular back shroud;

a spaced parallel annular shroud; and a plurality of vanes each having a proximal end fastened to said back shroud, a spaced distal end fastened to said annular shroud, a leading edge extending between said proximal and distal ends and inclined in a direction of said impellers' path of rotation about said axis, and a spaced trailing edge, said vanes being equally spaced from each other and defining impeller channels therebetween;

a circular opening defined by said annular shroud about said central axis in fluid communication with said suction inlet, said circular opening having a diameter approximately equal to the diameter of said suction inlet; and a central shaft rotatably supported on said shell and extending along said axis, said shaft being operably engaged with said back shroud for rotating said impeller about said axis;

wherein said proximal end of each vane extends along an arc of approximately 105° from said trailing edge to said leading edges said distal end of each vane extends along an arc of approximately 80° from said trailing edge to said leading edge, and each respective one of said impeller channels is sized and shaped to pass at least one of the solids therethrough.

2. The centrifugal pump defined in claim 1, wherein each respective one of said impeller channels is sized and shaped to pass the at least one spherically shaped solid therethrough in which the major diameter of the at least one spherically shaped solid has a length equal to approximately 37.5% of the diameter of said circular opening.

3. The centrifugal pump defined in claim 1, wherein each of said vanes has a proximal end fastened to said back shroud and a spaced distal end fastened to said annular shroud, and a body portion formed intermediate said proximal and said distal ends, said body portion having a thickness in the range of from approximately 6% to approximately 8% of the length of the diameter of said circular opening.

4. The centrifugal pump defined in claim 3, wherein each of said vanes has a body portion thickness of approximately 7.25% of the length of the diameter of said circular opening.

5. The centrifugal pump defined in claim 1, wherein said discharge opening has a substantially circular cross-section and an inside diameter, the inside diameter of said discharge opening being approximately equal to the diameter of said circular opening.

6. The centrifugal pump defined in claim 1, wherein each respective one of said impeller channels is sized and shaped to pass the at least one spherically shaped solid therethrough in which the major diameter of the at least one spherically shaped solid is approximately 14.25 inches in length.

7. The centrifugal pump defined in claim 3, wherein each respective one of said vanes has a body portion thickness of at least 2.75 inches.

8. The centrifugal pump defined in claim 1, wherein said circular opening has a diameter of at least 38 inches.

9. The centrifugal pump defined in claim 1, wherein said impeller is rotated in said shell collector by said prime mover and said vanes of said impeller are of a sufficient size and shape to produce a slurry through-flow of approximately 52,000 gallons per minute at a pump efficiency of approximately 85%.

10. The centrifugal pump defined in claim 1, wherein said impeller is rotated in said shell collector by said prime mover and said vanes of said impeller are of a sufficient size and shape to produce a total dynamic head of 35 feet with a pump efficiency of approximately 85%.

11. The centrifugal pump defined in claim 1, wherein said impeller is sized and shaped, and rotated in said shell collector by said prime mover sufficiently to produce a total dynamic head of 35 feet with a pump efficiency of approximately 85%.

12. The centrifugal pump defined in claim 1, wherein each of said vanes has a proximal end fastened to said back shroud and a spaced distal end fastened to said annular shroud, and wherein the proximal end, and the distal end, respectively, of each said vane has a thickness of approximately 4% of the length of the diameter of said circular opening.

13. The centrifugal pump defined in claim 1, wherein said shell collector has a width between the front wall and the back wall thereof, said width being in the range of from approximately 55% to approximately 65% of the length of the diameter of said circular opening.

14. The centrifugal pump defined in claim 13 wherein said shell collector has a width of approximately 60% of the length of the diameter of said circular opening.

15. The centrifugal pump defined in claim 1, wherein said impeller has a nominal diameter at said back shroud of approximately 116% of the diameter of the circular opening of the annular shroud, and wherein said impeller has a nominal diameter at said annular shroud of approximately 126% of the diameter of said circular opening.

16. The centrifugal pump defined in claim 1, wherein each of said impeller channels defines an outlet between a leading edge of a first vane and an intermediate portion of an adjacent second vane, each said outlet being sized and shaped to pass the spherically shaped solids of the slurry into the discharge nozzle of the shell, respectively, and wherein each of said impeller channel outlets is directed substantially radially away from said central axis.

17. A centrifugal slurry pump for pumping a slurry comprised of liquid and a plurality of solids carried by the liquid, each of the solids having a major diameter across its widest portion, said pump comprising:

a pump housing, said housing being formed about a central axis;

a circular opening defined within said pump housing for allowing the slurry to enter the housing;

an impeller rotatably supported within said housing about said central axis, said impeller including:

a series of spaced impeller vanes, said vanes being spaced equidistant from one another about said axis and defining a series of impeller channels between adjacent ones of said impeller vanes;

each of said vanes comprising a proximal end fastened to said back shroud, a spaced distal end, a spaced distal end a leading edge extending between said proximal and said distal ends at a first end of the vane and inclined in the anticipated direction of the impeller's path of rotation about said axis and a spaced trailing edge extending between said proximal and said distal ends; and a circular suction inlet formed about said axis, said suction inlet being in fluid communication with the circular opening defined within said housing, said suction inlet having a suction inlet diameter approximately equal to the diameter of said circular opening;

wherein the proximal end of each said vane extends along an arc of approximately 105° from the trailing edge toward the leading edge; and the distal end of each said vane extends along an arc of approximately 80° from said the trailing edge toward the leading edge; and wherein each respective one of said impeller channels defines a passage for the solids therethrough, each respective one of said passages having a width in the range of from approximately 34% to approximately 40% of the length of said suction inlet diameter.

18. The pump of claim 17, said housing further comprising a substantially circular back wall, a parallel, spaced, and substantially circular front wall, a continuous side wall extending between said front wall and said rear wall about the periphery of said housing, and a discharge nozzle defined within said side wall, said discharge nozzle defining a discharge opening for passing the slurry from out of said housing.

19. The pump of claim 17, comprising a drive shaft rotatably supported on said housing and extending along said axis, said drive shaft being operably engaged with said impeller, and a prime mover for rotating said drive shaft and said impeller about said axis.

20. The pump of claim 17, said impeller further comprising a substantially circular back shroud and a spaced, parallel, substantially circular annular front shroud, wherein each of said vanes is fastened to and extends between said back shroud and said annular shroud.

21. The centrifugal pump of claim 17, wherein each of said impeller channels defines an outlet between a leading edge of a first vane and an intermediate portion of an adjacent second vane, each said outlet being sized and shaped to pass the spherically shaped solids of the slurry into a discharge nozzle defined within the shell, and wherein each of said impeller channel outlets is directed substantially radially away from said central axis.

22. The centrifugal pump of claim 17, each of said vanes having:

a proximal end;

a spaced distal end; and a body portion formed intermediate said proximal and said distal ends;

wherein said body portion has a thickness in the range of from approximately 6% to approximately 8% of the length of the diameter of said suction inlet;

and wherein said proximal end and said distal end, respectively, each has a thickness of approximately 4% of the length of the diameter of said suction inlet.

* * * * *